US006612464B2

(12) United States Patent
Petterson et al.

(10) Patent No.: US 6,612,464 B2
(45) Date of Patent: Sep. 2, 2003

(54) AEROSOL DISPENSING VALVE

(75) Inventors: Tor H. Petterson, deceased, late of Rancho Palos Verdes, CA (US), by Grace C. Petterson, executor; Michael G. Knickerbocker, St. George, UT (US); David J. Houser, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/010,319

(22) Filed: Nov. 13, 2001

(65) Prior Publication Data

US 2003/0106912 A1 Jun. 12, 2003

(51) Int. Cl.[7] ..... G01F 11/00

(52) U.S. Cl. ..... 222/1; 222/645; 222/649; 222/402.13

(58) Field of Search ..... 222/1, 644, 645, 222/649, 402.11, 402.13, 402.2

(56) References Cited

U.S. PATENT DOCUMENTS

| | | | | |
|---|---|---|---|---|
| 3,419,189 A | * | 12/1968 | Iketani | 222/54 |
| 3,477,613 A | | 11/1969 | Mangel | |
| 3,497,108 A | | 2/1970 | Mason | 222/61 |
| 3,542,248 A | | 11/1970 | Mangel | 222/70 |
| 3,658,209 A | | 4/1972 | Freeman et al. | |
| 4,077,542 A | | 3/1978 | Petterson | |
| 4,396,152 A | | 8/1983 | Abplanalp | |
| 5,018,963 A | | 5/1991 | Diederich | |
| 5,025,962 A | * | 6/1991 | Renfro | 222/649 |
| 5,702,036 A | | 12/1997 | Ferrara | 222/402.13 |
| 5,791,524 A | | 8/1998 | Demarest | 222/153.06 |
| 6,216,925 B1 | | 4/2001 | Garon | 222/645 |
| 6,478,199 B1 | * | 11/2002 | Shanklin et al. | 222/402.22 |
| 6,533,141 B1 | * | 3/2003 | Petterson et al. | 222/1 |

FOREIGN PATENT DOCUMENTS

| | | |
|---|---|---|
| EP | 826608 A1 | 3/1998 |
| JP | 3-85170 | 4/1991 |
| JP | 10216577 | 8/1998 |
| JP | 2001048254 | 2/2001 |

OTHER PUBLICATIONS

Patent Abstracts of Japan vol. 015, No. 256 (C–0845), Jun. 28, 1991 & JP 03 085170 A (Showa Seiki KK), Apr. 10, 1991 abstract—Spray Amount Control Mechanism of Automatic Jet Apparatus.

* cited by examiner

*Primary Examiner*—Joseph A. Kaufman

(57) ABSTRACT

A valve assembly can automatically dispense aerosol content from an aerosol container at predetermined intervals without the use of electric power. A diaphragm at least partially defines an accumulation chamber that receives aerosol content from the can during an accumulation phase. Once the internal pressure of the accumulation chamber reaches a predetermined threshold, the diaphragm moves axially, carrying with it a leg so as to unseal an outlet, and thereby initiate a spray burst. A pawl extends from the diaphragm, and engages a retention surface to resist movement of the diaphragm and prolong the accumulation phase. The diaphragm assumes its original position when the pressure within the accumulation chamber falls below a threshold pressure.

11 Claims, 6 Drawing Sheets

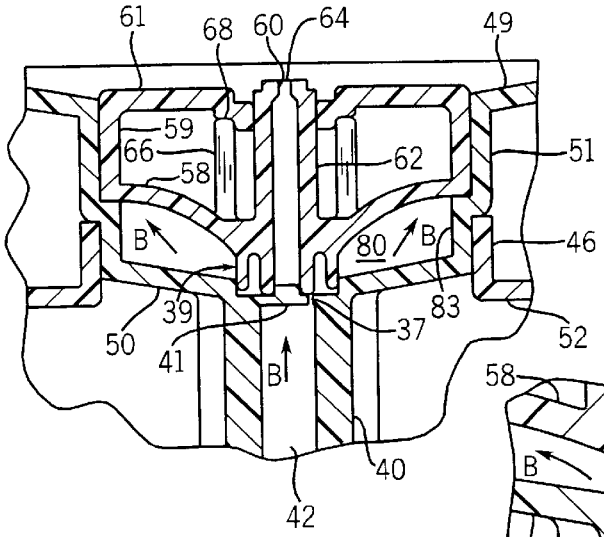
FIG. 3
FIG. 4
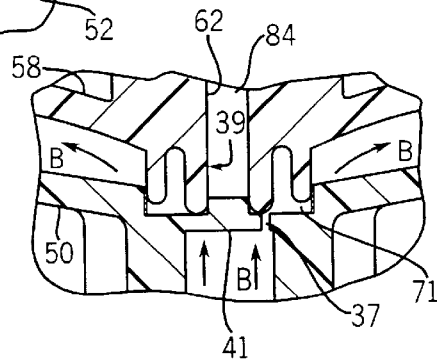
FIG. 5
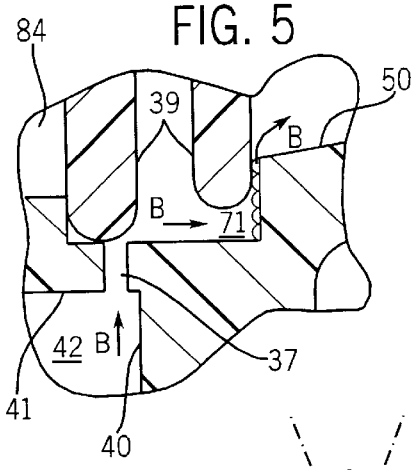
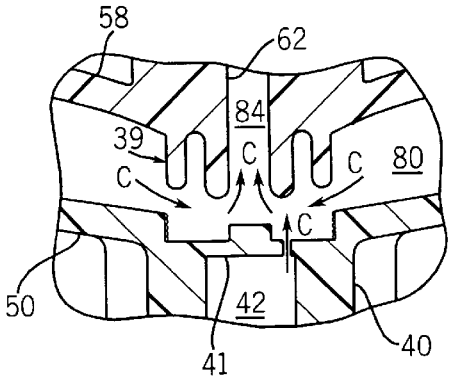
FIG. 7
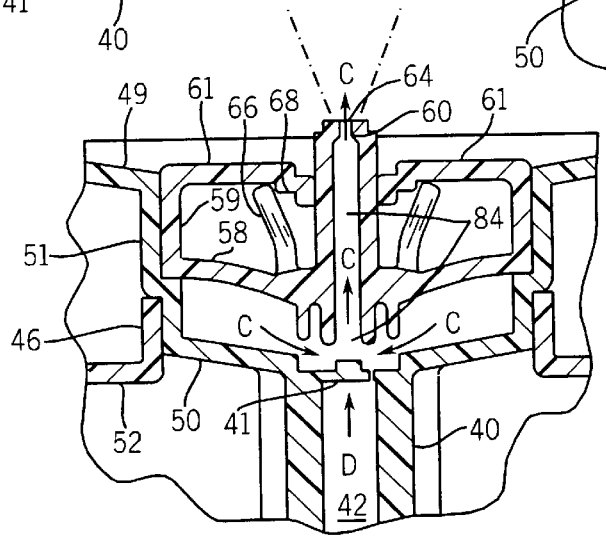
FIG. 6

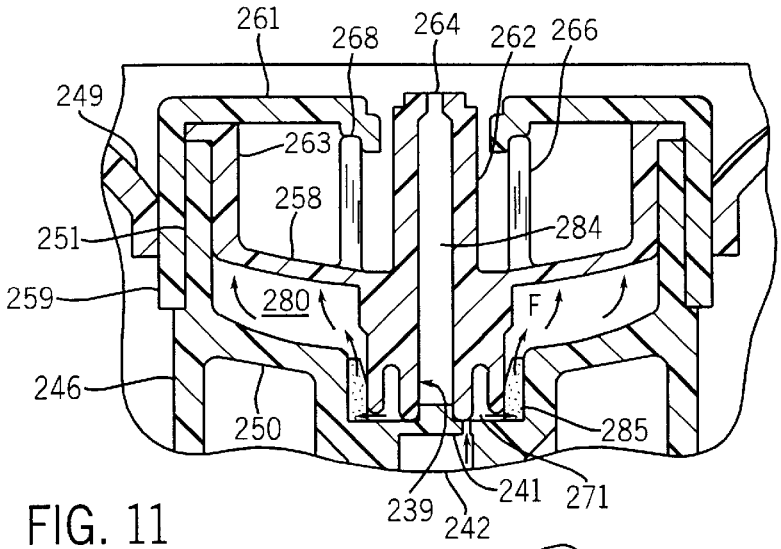
FIG. 11
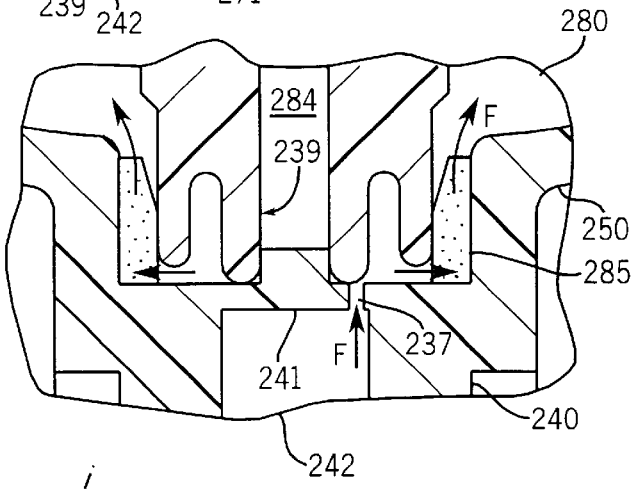
FIG. 12
FIG. 13
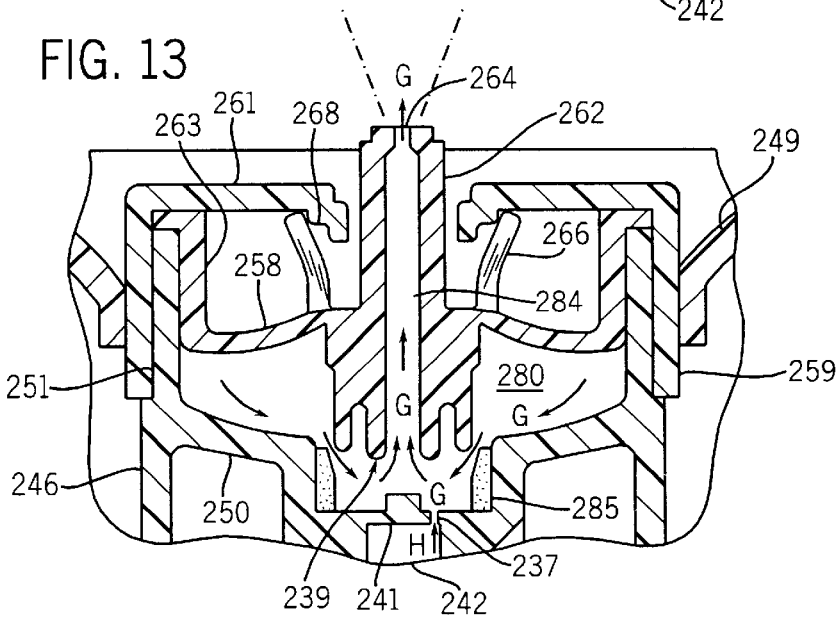

AEROSOL DISPENSING VALVE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol dispensing devices, and in particular to valve assemblies that provide automatic dispensing of aerosol content at predetermined time intervals, without requiring the use of electrical power.

Aerosol cans dispense a variety of ingredients. Typically, an active is mixed with a propellant which may be gaseous, liquid or a mixture of both (e.g. a propane/butane mix; carbon dioxide), and the mixture is stored under pressure in the aerosol can. The active mixture is then sprayed by pushing down/sideways on an activator button at the top of the can that controls a release valve. For purposes of this application, the term "chemical" is used to mean liquid, liquid/gas, and/or gas content of the container (regardless of whether in emulsion state, single phase, or multiple phase).

The pressure on the button is typically supplied by finger pressure. However, for fragrances, deodorizers, insecticides, and certain other actives which are sprayed directly into the air, it is sometimes desirable to periodically refresh the concentration of active in the air. While this can be done manually, there are situations where this is inconvenient. For example, when an insect repellant is being sprayed to protect a room overnight (instead of using a burnable mosquito coil), the consumer will not want to wake up in the middle of the night just to manually spray more repellant.

There a number of prior art systems for automatically distributing actives into the air at intermittent times. Most of these rely in some way on electrical power to activate or control the dispensing. Where electric power is required, the cost of the dispenser can be unnecessarily increased. Moreover, for some applications power requirements are so high that battery power is impractical. Where that is the case, the device can only be used where linkage to conventional power sources is possible.

Other systems discharge active intermittently and automatically from an aerosol can, without using electrical power. For example, U.S. Pat. No. 4,077,542 relies on a biased diaphragm to control bursts of aerosol gas at periodic intervals. See also U.S. Pat. Nos. 3,477,613 and 3,658,209. However, biased diaphragm systems have suffered from reliability problems (e.g. clogging, leakage, uneven delivery). Moreover, they sometimes do not securely attach to the aerosol can.

Moreover, the cost of some prior intermittent spray control systems makes it impractical to provide them as single use/throw away products. For some applications, consumers may prefer a completely disposable product.

Thus, a need still exists for improved, inexpensive automated aerosol dispensers that do not require electrical power.

BRIEF SUMMARY OF THE INVENTION

In one aspect the invention provides a valve assembly that is suitable to dispense a chemical from an aerosol container.

It can automatically iterate between an accumulation phase where the chemical is received from the container, and a spray phase where the received chemical is automatically dispensed at intervals.

The valve assembly has a housing mountable on an aerosol container, a movable diaphragm associated with the housing which is linked to a leg, the diaphragm being biased towards a first configuration. A pawl is also linked to the diaphragm, and there is an accumulation chamber inside the housing for providing variable pressure against the diaphragm. There is also a first passageway in the housing suitable for linking an interior portion of the aerosol container with the accumulation chamber, a second passageway in the housing suitable for linking the accumulation chamber with an outlet of the valve assembly, and a retention surface linked to the housing and facing the pawl.

When the diaphragm is in the first configuration the pawl abuts against the retention surface and the valve assembly can prevent spray of the chemical out of the valve assembly and permit chemical to flow from the aerosol container into the accumulation chamber via the first passageway. When the pressure of chemical inside the accumulation chamber exceeds a specified threshold the pawl can move off the retention surface and the diaphragm can move from the first configuration to a second configuration wherein spray is permitted to exit the valve assembly.

In preferred forms a barrier is disposed in the first passageway to regulate the flow of chemical there through, a toe of the pawl can flare radially outwardly off of the retention surface as the diaphragm moves from the first configuration to the second configuration, the accumulation chamber further comprises a base having a surface facing the leg to define an inlet to the accumulation chamber, and the surface of the inlet is textured to regulate the flow of chemical into the accumulation chamber. If desired, a porous material can instead at least partially block the inlet to regulate the flow of chemical into the accumulation chamber.

In another aspect the leg is axially displaced to open the second passageway as the diaphragm approaches the second configuration, the diaphragm will shift back to the first configuration from the second configuration when pressure of the chemical in the accumulation chamber falls below a threshold amount, and the accumulation chamber has a base that is sloped so as to direct liquid chemical that may collect in the accumulation chamber towards the first passageway.

In other alternatives there may be a spring disposed in the housing operable to resist axial movement of the diaphragm from the first to the second configuration, and an actuator can be rotatable to cause chemical to be able to leave the container and enter the first passageway.

In yet another aspect, methods are provided for using these valve assemblies with aerosol containers are also disclosed.

The present invention achieves a secure mounting of a valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and begins the cycle of periodic and automatic dispensing of chemical there from. Importantly, periodic operation is achieved without requiring the use of electrical power to motivate or control the valve.

The valve assembly has few parts, and is inexpensive to manufacture and assemble. Further, it is relatively selfcleaning to help avoid clogs and/or inconsistent bursts. For example, the movement of the pawl and leg help reduce residue accumulation.

The foregoing and other advantages of the invention will appear from the following description. In the description reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the scope of the invention.

BRIEF DESCRIPTION OF THE DRAWINGS

FIG. 3 is an enlarged detail sectional view focusing on a portion of the FIG. 2 view;

FIG. 4 is a further enlarged section view of the inlet of FIG. 3;

FIG. 5 is a still further enlarged sectional view of the inlet of FIG. 3;

FIG. 6 is a view similar to FIG. 3, but with the valve shown during the spray phase;

FIG. 7 is a view similar to FIG. 4, but showing the valve during the spray phase;

FIG. 11 is an enlarged detail sectional view focusing on a portion of the FIG. 10 view;

FIG. 12 is a further enlarged section view of the inlet of FIG. 11;

FIG. 13 is a view similar to FIG. 11, but with the valve assembly in the spray phase;

DETAILED DESCRIPTION OF THE PREFERRED EMBODIMENT

Figure 1:
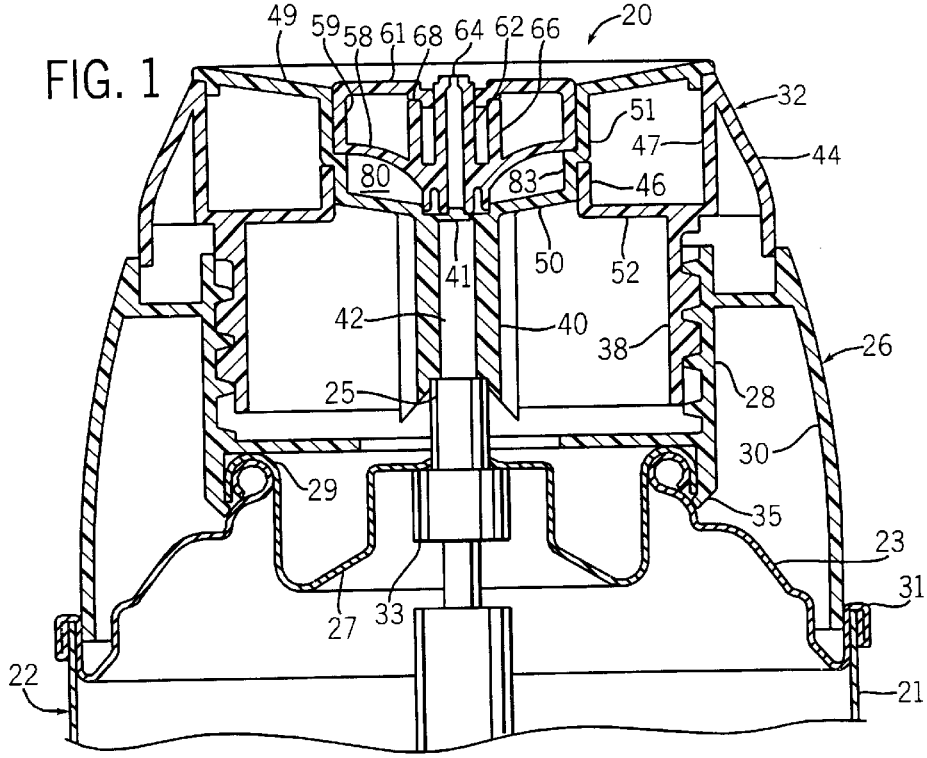
FIG. 1 is a sectional view of an automatic dispensing valve of the present invention in an "off" configuration, mounted onto an aerosol can.

Referring initially to FIG. 1, an aerosol can 22 includes a cylindrical wall 21 that is closed at its upper margin by the usual dome 23. The joint between the upper margin of the can wall 21 and the dome 23 is the can chime 31. An upwardly open cup 27 is located at the center of the dome 23 and is joined to the dome by a rim 29.

A conventional valve 33 is located at the center of the valve cup 27. The valve 33 has an upwardly extending valve stem 25, through which the contents of the can may be expelled. Valve 33 is shown as a vertically actuable valve, which can be opened by moving the valve stem 25 directly downwardly. Instead, one could use a side-tilt valve where the valve is actuated by tipping the valve stem laterally and somewhat downwardly.

A valve assembly 20, configured for engagement with the vertically actuated type valve 33, is mostly polypropylene, albeit other suitable materials can be used. The valve assembly 20 has a lower portion 26 including an inner wall 28 and peripheral skirt 30 that are joined at their axially outer ends. It should be appreciated that throughout this description, the terms "axially outer, axially downstream, axially inner, axially upstream" are used with reference to the longitudinal axis of the container. The term "radial" refers to a direction outward or inward from that axis.

The inner wall 28 and skirt 30 engage the valve cup rim 29 and can chime 31, respectively. In particular, inner wall 28 has a radially inwardly extending flange 35 that is configured to snap-fit over the rim 29, while skirt 30 engages the inner surface of chime 31. In operation, the dispenser 20 can be forced downwardly onto the chime 18 and rim 29, thus fastening the dispenser 20 to the aerosol can 22.

Inner wall 28 is threaded on its radially inner surface to receive an assembly 32 that is rotatable therein. Assembly 32 includes an annular wall 38 that is threaded on its outer surface to engage the threads of inner wall 28. The threads have a predetermined pitch such that, as the assembly 32 is rotated clockwise with respect to the assembly 26, it is displaced axially along the direction of Arrow A with respect to aerosol can 22 to activate the valve 33 (FIG. 2) and begin an iterative dispensing cycle. The dispenser 20 may subsequently be disengaged from the can 22 by rotating assembly 32 counterclockwise, and is thus saved for future use.

The dispensing cycle includes an accumulation phase and a spray phase. During the accumulation phase, aerosol content flows from can 22 and into the dispenser to generate pressure therein. Once the pressure within the dispenser reaches a predetermined threshold, the spray phase is initiated, whereby the aerosol content disposed within the dispenser exits via an outlet 64. During the spray phase, additional aerosol content is permitted to flow from can 22 and out the outlet 64. Accordingly and importantly, the spray that is projected by the dispenser may include a greater amount of chemical than that stored in the dispenser during the previous cycle. Once a sufficient amount of chemical is expelled from the dispenser 20 such that the internal pressure above the diaphragm subsides, the accumulation phase again initiated.

Assembly 32 further includes an annular wall 40 disposed radially inwardly of wall 38 that defines therein an axially extending cylindrical first pathway portion 42 that is axially aligned with valve 33. When assembly 26 is initially mounted onto aerosol can 22, the axially inner edge of wall 40 is located adjacent and radially aligned with the valve stem 25. However, it is not pressing down on stem 33.

Because the valve stem 33 is not yet activated in this position, the valve assembly 32 has not yet engaged the aerosol can 22, and the assembly is in a storage/shipment position. However, as the valve assembly 32 is rotated to displace the dispenser 20 along the direction of arrow A, wall 40 depresses the valve stem 25, thereby engaging the valve assembly with the aerosol can 22 and allowing the aerosol content to flow from the can into the upper valve assembly.

Assembly 32 further includes an annular wall 47 that extends axially downstream from wall 38, and is displaced slightly radially outwardly with respect thereto. An outer annular sealing wall 44 extends axially upstream and radially outwardly from the axially outermost edge of wall 47. The outer surface of axially inner portion of wall 44 engages the inner surface of a flange on skirt 30, and is rotatable with respect thereto to provide a seal between the mounting assembly 26 and valve assembly 32. Wall 44 is also easily engageable by a user to rotate the mounting assembly 26, as described above.

Wall 40 is integrally connected at its axially outermost end to a wall 50 that extends radially outwardly there from, and terminates in a substantially axially extending wall 83. Wall 83 extends axially downstream, and connects to an axially extending wall 51 that is radially outwardly displaced from wall 83. Wall 38 is integrally connected at its axially outermost end to a wall 52 that extends radially inwardly from wall 47. Wall 52 further extends axially downstream at its radially inner edge to provide a seat for wall 51. Wall 51 is integrally connected at its axially outer edge to a cover 49 that extends substantially radially outwardly to wall 47. In particular, cover 49 has an axially inwardly extending notch disposed proximal its radially outer edge that engages the inner surface of wall 47 to secure the cover in place. Cover 49 is annular to define a centrally disposed opening that serves as outlet 64 for aerosol content, as will become more apparent from the description below.

As best seen in FIGS. 3–7, valve assembly 32 has an annular base which is defined by annular wall 50 that extends radially between walls 40 and 51. Wall 50 includes a centrally disposed barrier 41 aligned with conduit 42, having at least one aperture 37 extending there through and enables fluid (e.g. liquid/gas) to flow from the can 22 into dispenser 20.

A flexible, mono-stable diaphragm 58 is disposed within valve assembly 32, and is movable between a first closed position (FIG. 3), and a second open position (FIG. 6) to activate the valve assembly at predetermined intervals, as will be described in more detail below. Diaphragm 58 is a radially extending bow-shaped wall whose concave surface faces wall 50. The diaphragm is integrally connected at its radially outer edge to an axially extending wall 59 disposed radially inwardly of, and adjacent wall 51. Wall 59 is integrally connected at its axially outer end to a cover 61. Diaphragm 58 further includes a radially inner, axially extending annular leg structure 62 whose radially outer surface abuts the radially inner surface of cover 61. Leg has, at its axially outer end, an outlet 64 of the dispenser 20 defined by a nozzle 60. Leg 62 is further integrally connected to diaphragm 58 proximal its axially inner end, such that an annular reservoir 80 is defined by wall 50, wall 51, diaphragm 58, and leg 62. Reservoir 80 provides an accumulation chamber that receives chemical from can 22 during the accumulation phase.

A flexible pawl 66 extends axially upstream from the radially inner edge of diaphragm 58. Cover 61 includes an inner retention surface 68 that slopes in step fashion from leg 62 to cover 61. In particular, retention surface 68 is stepped such that the axially upper surface of pawl 66 engages the step when the diaphragm 58 is relaxed. It should be appreciated that pawl could alternatively extend from any surface that is axially movable along with the diaphragm 58.

Leg 62 further includes at its axially inner end an annular fork/foot 39 extending upstream there from. The inner prong of fork 39 abuts barrier 41 to form a seal therewith during the accumulation part of the cycle, while the outer prong is recessed from the inner prong, and abuts the radially textured inner surface of wall 50. Accordingly, a channel 71 (defined by aperture 37, outer prong of fork 39, and wall 50) extends from conduit 42 and allows chemical to flow into accumulation chamber 80 along the direction of Arrow B during an accumulation phase, as illustrated in FIGS. 4 and 5. Because the inner prong of fork 39 is sealed against the radially outer edge of barrier 41, fluid is unable to flow out of accumulation chamber during the accumulation phase.

As best illustrated in FIG. 5, the radially inner surface of wall 50 is textured to provide a timing seal that permits a slow leak to allow chemical to flow into accumulation chamber 80 from conduit 42. The textured surface thus provides flow regulation. As pressure increases due to a temperature rise in a room in which the can is stored, the forks 39 will tend to deflect outward and thus more tightly against the textured surface. This reduces the cross-sectional area of passages through the textured surface, thereby reducing flow to compensate for the increased room temperature.

The textured surface can be molded as part of the adjoining wall using the same material (e.g. polypropylene, polyethylene, etc.). Alternatively, the surface could be adhered to the wall, or the wall could even be smooth which would enable a greater flow rate into accumulation chamber 80. The textured surface could also be of an elastomeric material such as Kraton that is co-molded, or two-shot molded onto the wall.

In operation, a consumer rotates the valve assembly 32 relative to mounting assembly 26, preferably by rotating wall 44. This causes the valve assembly 32 to become displaced axially inwardly, and biases wall 40 against valve stem 25, thereby causing the aerosol contents to flow out of can 22, and beginning the accumulation phase. The aerosol contents flow through conduit 42 and into opening 37, through channel 71, and into accumulation chamber. The rate at which the aerosol contents are able to flow through channel 82 can be regulated by the density and configuration of texture on wall 50, as well as the number of apertures extending through barrier 41.

During the accumulation phase, the constant supply of aerosol content flowing from intake channel 82 into the accumulation chamber 80 causes pressure to build therein, and such pressure acts against the underside of diaphragm 58. Once the accumulation chamber 80 is sufficiently charged with aerosol content, such that the pressure reaches a predetermined threshold, the mono-stable diaphragm 58 becomes deformed from the normal closed position illustrated in FIG. 3 to the open position illustrated in FIG. 6. This initiates a spray phase as inner prong of fork 39 no longer abuts against barrier 41.

The deformation of diaphragm 58 is resisted by the flexibility of the diaphragm along with the engagement of the pawl 66 with retention surface 68. The internal pressure continues to accumulate within the accumulation chamber 80 until it exceeds the maximum pressure threshold, at which point a toe of the pawl 66 flares radially outwardly off of the surface 68 as the diaphragm approaches the second configuration. This allows the diaphragm 58 to open by flexing axially outwardly from the hinge between formed between its radially outer edge and wall 59.

Leg 62 travels along with the radially inner edge of diaphragm 58 such that, when the diaphragm is open, leg 62 and fork 39 are moved downstream of barrier 41 to create an outlet channel 84 extending through leg 62, between accumulation chamber 80 and the outlet end 64 of the dispenser 20. Accordingly, during the spray phase, the stored aerosol content flows from accumulation chamber 80, along outtake channel 84 along the direction of arrow C (FIG. 7), and exits the outlet end 64 of dispenser 20 as a "puff" into the ambient environment.

Axial movement of leg 62 removes the outer prong of fork from wall 50, thereby enabling an even greater flow rate out of the accumulation chamber 80 during the spray phase than the flow rate into the accumulation chamber during the accumulation phase. Furthermore, because the seal between inner prong of fork 39 and barrier 41 is removed during the start of the spray phase, aerosol content is able to flow from can 22 along the direction of Arrow D, and directly out the outlet end 64, such that the output spray comprises more chemical than that stored in accumulation chamber 80 during the previous accumulation phase. The amount of chemical escaping from can 22 during the spray phase may be regulated by the duration of the spray phase as well as the size and number of opening(s) 37. The duration of spray phase may be controlled by many factors, such as the size of accumulation chamber 80, flexibility of diaphragm 58, flexibility of pawl 66, and slope of retention surface 68.

During the spray phase, the pressure within the accumulation chamber immediately abates as the stored aerosol content exits the dispenser 20. Once the pressure falls below a predetermined threshold, the diaphragm snaps back to its normal position, re-establishing the seal inner prong of fork 39 and barrier 41, and re-engaging the outer prong with textured surface of wall 50. As the diaphragm 58 closes, pawl 66 rides along, and re-engages, retention surface 68 to again initiate the accumulation phase. Aerosol content flowing through opening 37 is thus directed through intake channel 71 and into accumulation chamber, as described above. The dispensing cycle is thus automatic and continuously periodic until the can contents are exhausted.

Figure 2:
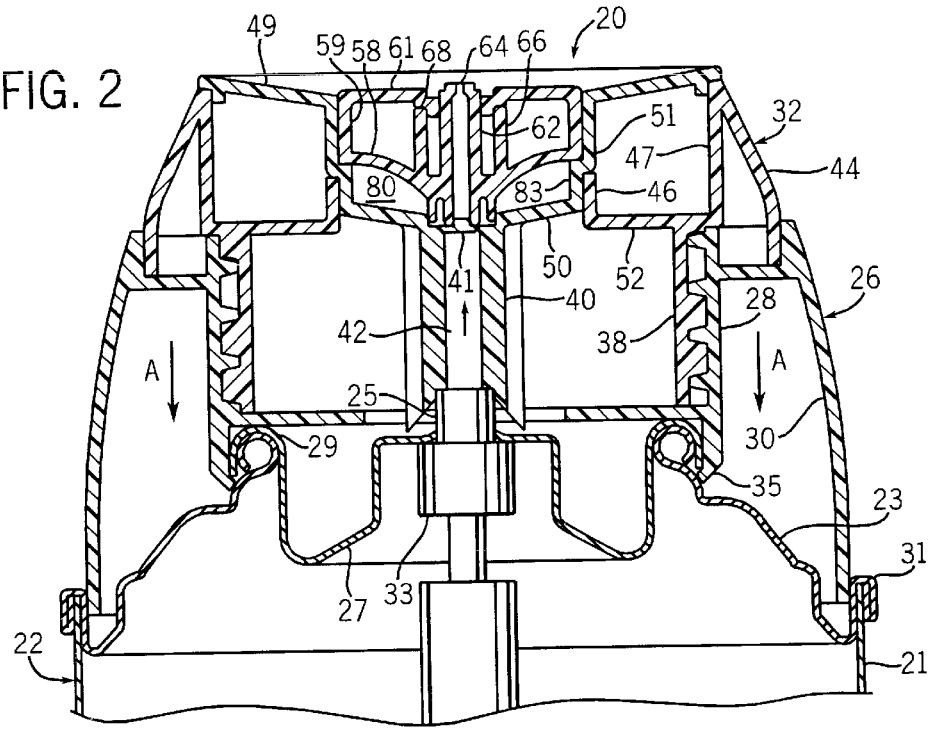
FIG. 2 is a view similar to FIG. 1, but with the valve in an "on" position.
Figure 8:
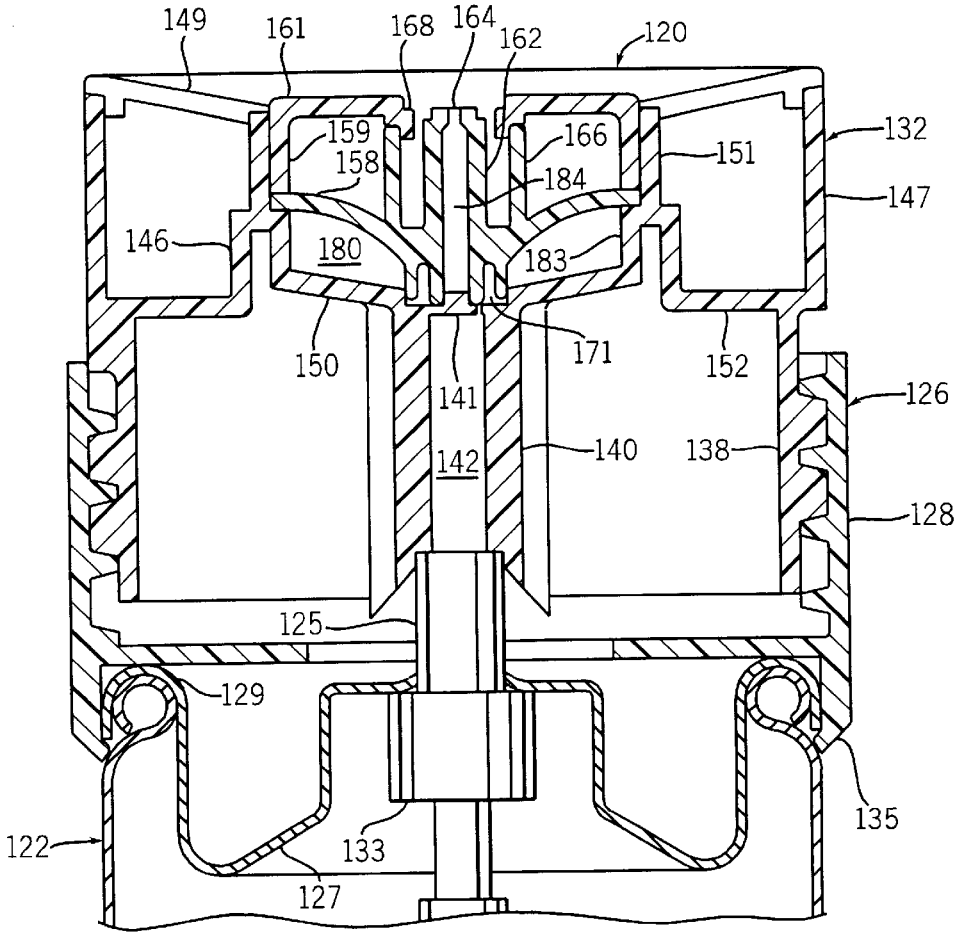
FIG. 8 is a view similar to FIG. 1, but of a second embodiment.

Referring now to FIG. 8, a dispenser is mounted onto an aerosol can 122 in accordance with an alternate embodiment of the invention. FIG. 8 is illustrated having reference numerals corresponding to like elements of the previous embodiment incremented by 100 for the sake of convenience. Dispenser 120 is configured to be mounted onto an aerosol can 122 that terminates at its radial end with a valve cup rim 129 rather than a chime as illustrated in FIGS. 1 and 2.

Accordingly, the mounting assembly includes a threaded wall 128 including radially inwardly extending flange 135 that engages valve cup rim to securely mount the dispenser 120 onto the can 122. Threaded wall 128 receives correspondingly threaded wall 138 such that a user rotates wall 147 to displace valve assembly 132 in the axial direction and actuate the dispenser 120, as described above.

Furthermore, wall 146 of dispenser 120 is integrally connected to wall 151. Radially outer end of diaphragm 158 is seated between walls 159 and 183. Additionally, cover 161 extends radially inwardly from wall 159, and terminates short of leg 162. As a result, cover 161 is permitted to flex outwardly slightly as the pawl 166 is biased axially outwardly under forces from diaphragm 158. The pawl 166 thus becomes more easily disengaged from retention surface 168, thereby reducing the duration of each accumulation phase.

When pressurizing the accumulation chamber 180, some gaseous materials may liquefy and could accumulate at the bottom of the accumulation chamber. This would result in them not being fully expelled during a single spray phase. The pooling of aerosol content could increasingly reduce the effective volume of accumulation chamber 180.

To address this problem, dispenser 120 includes an anti-pooling feature which prevents the accumulation of liquid within the accumulation chamber 180. In particular, base 150 of the accumulation chamber 180 slopes radially inwardly, such that unmixed liquid is forced towards channel 184 and in the path of aerosol content as it flows from the accumulation chamber 180 out the dispenser 120 during the spray phase. As a result, the liquid that has pooled during a single accumulation phase becomes mixed with the leaving propellant to produce a fine mist that is emitted out the dispenser 120 during the spray phase.

Figure 9:
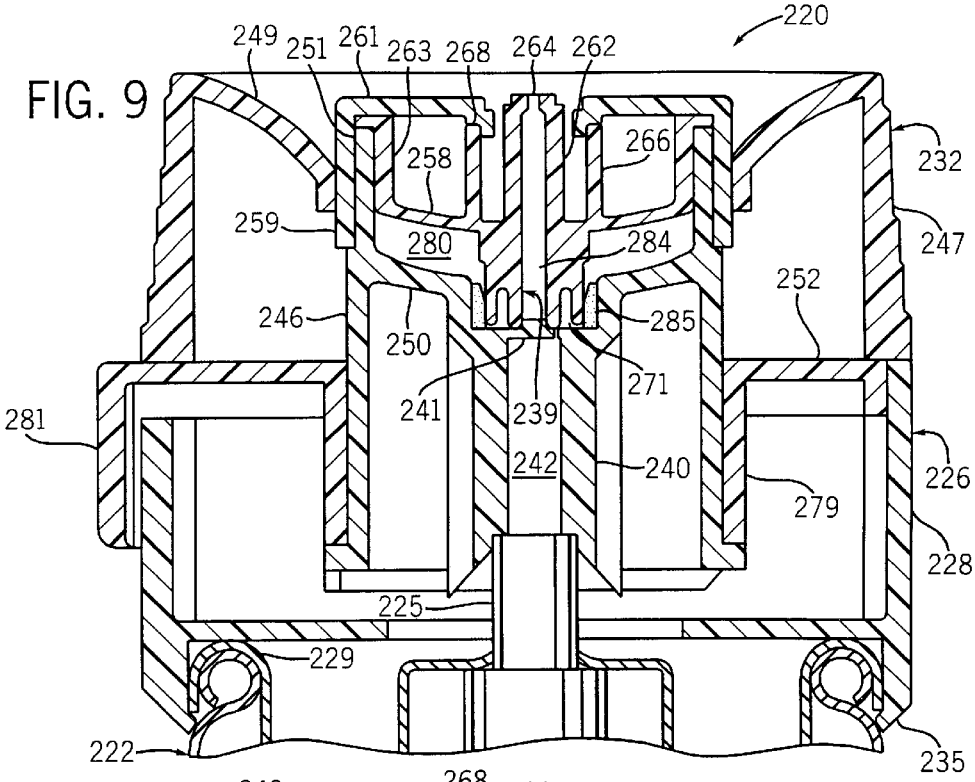
FIG. 9 is a view similar to FIG. 1, but of a third embodiment.
Figure 10:
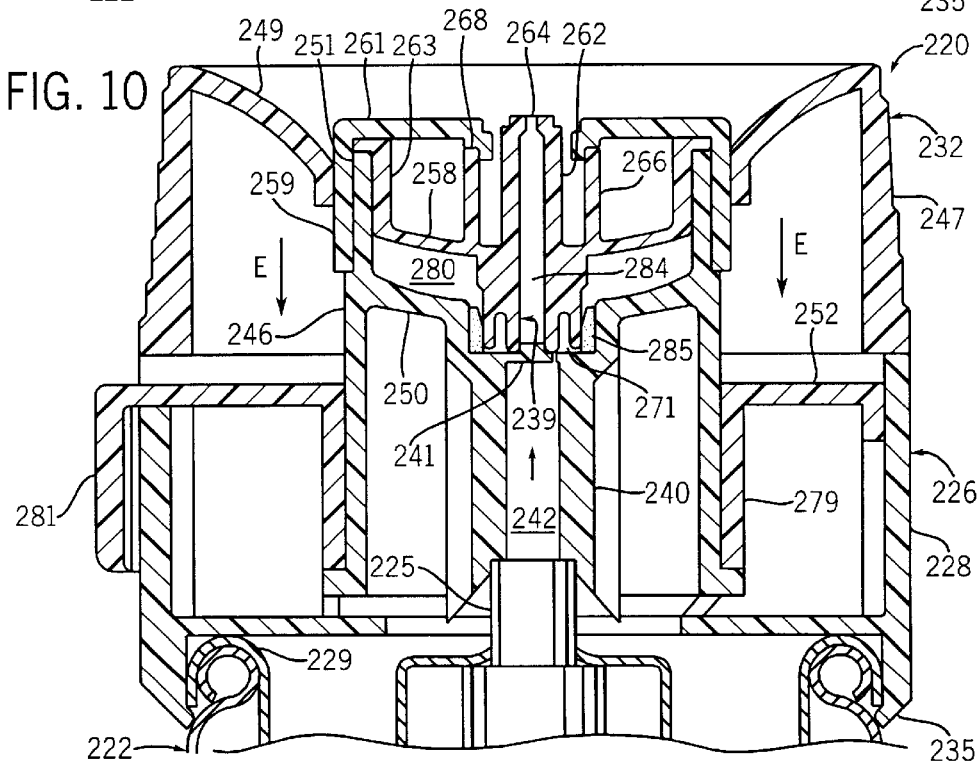
FIG. 10 is a view similar to FIG. 9, but showing the valve during an accumulation phase.

Referring next to FIG. 9, a third embodiment of the invention is illustrated having reference numerals corresponding to like elements of the previous embodiment incremented by 200. Mounting assembly 226 includes a lever 281 that may rotated by a user to displace the valve assembly 232 axially in the direction of Arrow E, as illustrated in FIG. 10 and described above. Additionally, lever 281 could include a perforated tab (not shown) between itself and wall 228 that is broken before the dispenser can be actuated, thereby providing means for indicating whether the dispenser has been tampered with. An annular hub 279 extends axially upstream from the radially inner edge of wall 252, and abuts the radially outer surface of wall 246.

Wall 259 extends axially upstream from the radially outer edge of cover 261, and abuts the radially inner edge of cover 249. Wall 251 is integrally connected wall 250, and extends axially outwardly there from between a void formed between wall 259 and wall 263, which extends axially downstream from the radially outer edge of diaphragm 258. A flange extends radially outwardly at the axially outer end of wall 263, and fits between the axially outer edge of wall 251, and the axially inner edge of cover 261 to secure the diaphragm 258 in place.

Furthermore, as better illustrated in FIGS. 11 and 12, the flow of aerosol content from the can 222 to the chamber 280 may be controlled using a flow regulator, such as a porous gasket 285. In particular, gasket 285 extends axially substantially the length of outer prong, and is disposed between the radially outer surface of outer prong of fork 239 proximal its axially inner end, and the radially inner surface of wall 250. Because gasket 285 is disposed in channel 271, any aerosol content flowing from can 222 into the chamber 280 along the direction indicated by Arrows F must pass through it, and thereby be slowed. Gasket 285 is preferably made of an open-celled foam or any other similarly permeable material. The installation of gasket 285 thus limits the flow rate of aerosol content from the can 222 to correspondingly prolong the accumulation cycle and decrease the frequency of sprays during operation.

Referring to FIG. 13, once the pressure within accumulation chamber 280 exceeds the maximum threshold during the accumulation cycle, the spray phase is initiated whereby pawl 266 becomes disengaged from retention surface 268, and diaphragm 258 flexes axially outwardly. Fork 239 becomes displaced axially outwardly from gasket, thereby allowing the stored aerosol content to flow from the accumulation chamber 280 along channel 284 in the direction of Arrows G, and out the outlet 264 as a spray. As described above, chemical content of can 222 also flows through orifice 237 in the direction of Arrow H, and along channel 284 to the outlet 264 during the spray cycle.

Figure 14:
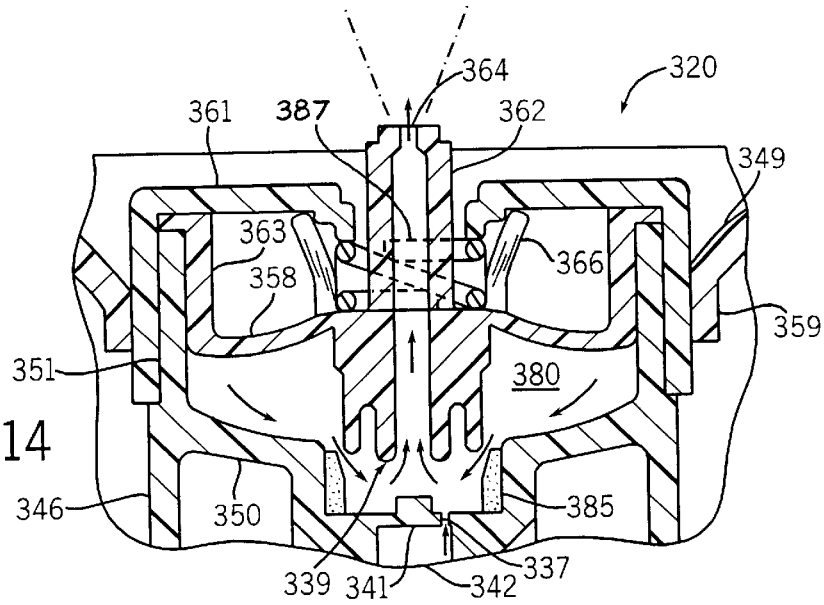
FIG. 14 is a view similar to FIG. 13, but of a fourth embodiment.

Referring next to FIG. 14, a fourth embodiment of the invention is illustrated having reference numerals corresponding to like elements of the previous embodiment incremented by 300. Dispenser 320 now includes a spring 387 that extends between the axially inner surface of cover 361 and axially outer surface of fork 339. Spring 387 biases diaphragm 358 towards its normal position and thus resists the transition to the spray phase. As a result, a greater amount of internal pressure generates within accumulation chamber 380 before the spray phase is initiated. This lengthens the duration of accumulation phases, and shortens the duration of spray phases.

Figure 15:
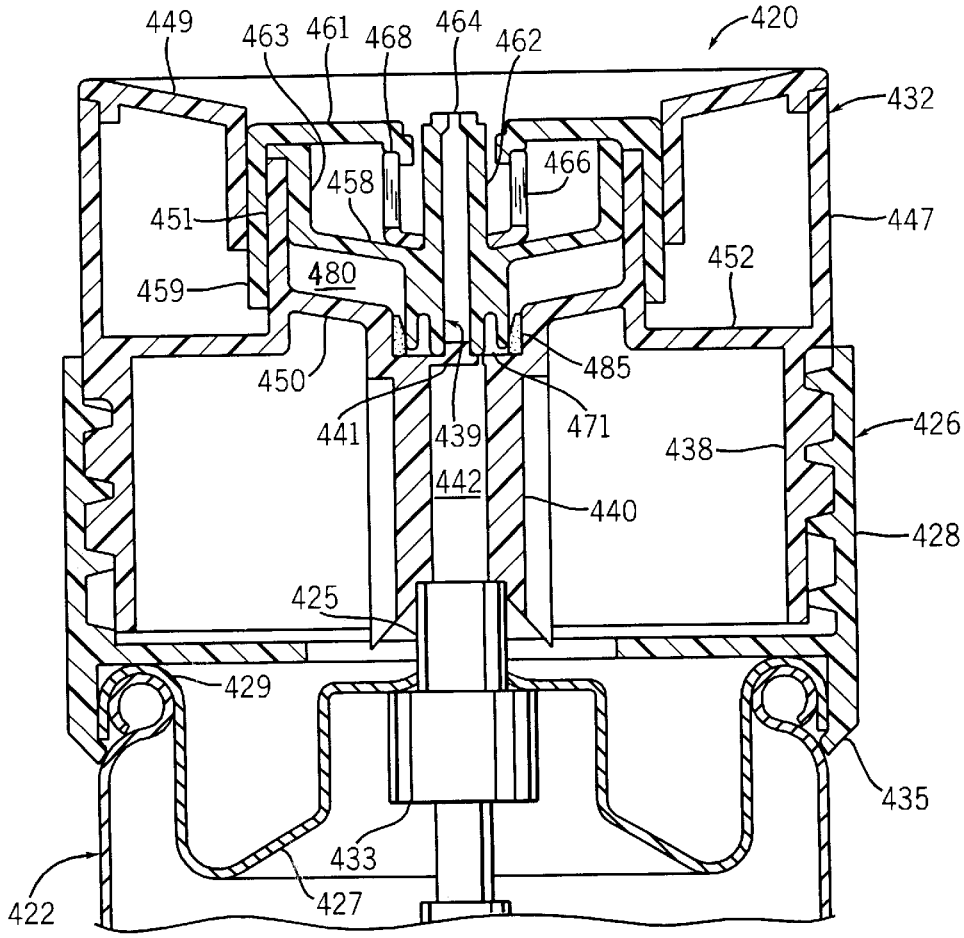
FIG. 15 is a view similar to FIG. 1, but of a fifth embodiment.

Referring next to FIG. 15, a fifth embodiment of the invention is illustrated having reference numerals corresponding to like elements of the previous embodiment incremented by 400. Dispenser 420 incorporates features similar to those described above with reference to FIGS. 8 and 9.

For instance, dispenser 420 is configured to be mounted onto an aerosol can 422 that terminates at its radial end with a valve cup rim 429 rather than a chime. Accordingly, the mounting assembly includes a threaded wall 428 including radially inwardly extending flange 435 that engages valve cup rim to securely mount the dispenser 420 onto the can 422. Threaded wall 428 receives correspondingly threaded wall 438 such that a user rotates wall 447 to displace valve assembly 432 in the axial direction and actuate the dispenser 420, as described above.

Additionally, wall 459 extends axially upstream from the radially outer edge of cover 461, and abuts the radially inner edge of cover 449. Wall 451 is integrally connected wall 450, and extends axially outwardly there from between a void formed between wall 459 and wall 463, which extends axially downstream from the radially outer edge of diaphragm 458. A flange extends radially outwardly at the axially outer end of wall 463, and fits between the axially outer edge of wall 451 and the axially inner edge of cover 461 to secure the diaphragm 458 in place. Dispenser 420 further includes flow regulator 485, as described above.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

Industrial Applicability

The present invention provides automated dispenser assemblies for dispensing aerosol can contents without requiring the use of electric power.

We claim:

1. A valve assembly that is suitable to dispense a chemical from an aerosol container, the valve assembly being of the type that can automatically iterate between an accumulation phase where the chemical is received from the container, and a spray phase where the received chemical is automatically dispensed at intervals, the valve assembly comprising:

a housing mountable on an aerosol container;

a movable diaphragm associated with the housing which is linked to a leg, the diaphragm being biased towards a first configuration;

a pawl also linked to the diaphragm;

an accumulation chamber inside the housing for providing variable pressure against the diaphragm;

a first passageway in the housing suitable for linking an interior portion of the aerosol container with the accumulation chamber;

a second passageway in the housing suitable for linking the accumulation chamber with an outlet of the valve assembly; and a retention surface linked to the housing and facing the pawl;

whereby when the diaphragm is in the first configuration the pawl abuts against the retention surface and the valve assembly can prevent spray of the chemical out of the valve assembly and permit chemical to flow from the aerosol container into the accumulation chamber via the first passageway; and whereby when the pressure of chemical inside the accumulation chamber exceeds a specified threshold the pawl can move off the retention surface and the diaphragm can move from the first configuration to a second configuration wherein spray is permitted to exit the valve assembly.

2. The valve assembly as recited in claim 1, further comprising a barrier disposed in the first passageway to regulate the flow of chemical there through.

3. The valve assembly as recited in claim 1, wherein a toe of the pawl can flare radially outwardly off of the retention surface as the diaphragm moves from the first configuration to the second configuration.

4. The valve assembly as recited in claim 1, wherein the accumulation chamber further comprises a base having a surface facing the leg to define an inlet to the accumulation chamber, and the surface of the inlet is textured to regulate the flow of chemical into the accumulation chamber.

5. The valve assembly as recited in claim 1, wherein wherein the accumulation chamber further comprises a base having a surface facing the leg to define an inlet to the accumulation chamber, and a porous material at least partially blocks the inlet to regulate the flow of chemical into the accumulation chamber.

6. The valve assembly as recited in claim 5, wherein the leg is axially displaced to open the second passageway as the diaphragm approaches the second configuration.

7. The valve assembly as recited in claim 1, wherein the diaphragm will shift back to the first configuration from the second configuration when pressure of the chemical in the accumulation chamber falls below a threshold amount.

8. The valve assembly as recited in claim 1, wherein the accumulation chamber has a base that is sloped so as to direct liquid chemical that may collect in the accumulation chamber towards the first passageway.

9. The valve assembly as recited in claim 1, further comprising a spring disposed in the housing operable to resist axial movement of the diaphragm from the first to the second configuration.

10. The valve assembly as recited in claim 1, further comprising an actuator that is rotatable to cause chemical to be able to leave the container and enter the first passageway.

11. A method of automatically delivering a chemical from an aerosol container to an ambient environment at predetermined intervals, the method comprising the steps of:

(a) providing a valve assembly suitable for use to dispense a chemical from the aerosol container, the valve assembly being of the type that can automatically iterate without the use of electrical power between an accumulation phase where the chemical is received from the container, and a spray phase where the received chemical is automatically dispensed at intervals, the valve assembly comprising:

(i) a housing mountable on an aerosol container;

(ii) a movable diaphragm associated with the housing which is linked to a leg, the diaphragm being biased towards a first configuration;

(iii) a pawl also linked to the diaphragm;

(iv) an accumulation chamber inside the housing for providing variable pressure against the diaphragm;

(v) a first passageway in the housing suitable for linking an interior portion of the aerosol container with the accumulation chamber;

(vi) a second passageway in the housing suitable for linking the accumulation chamber with an outlet of the valve assembly; and (vii) a retention surface linked to the housing and facing the pawl;

whereby when the diaphragm is in the first configuration the pawl abuts against the retention surface and the valve assembly can prevent spray of the chemical out of the valve assembly and permit chemical to flow from the aerosol container into the accumulation chamber via the first passageway; and whereby when the pressure of chemical inside the accumulation chamber exceeds a specified threshold the pawl can move off the retention surface and the diaphragm can move from the first configuration to a second configuration wherein spray is permitted to exit the valve assembly;

(b) mounting the valve assembly to such an aerosol container; and (c) actuating the valve assembly.

* * * * *